US007090514B2

(12) United States Patent
Lu

(10) Patent No.: US 7,090,514 B2
(45) Date of Patent: Aug. 15, 2006

(54) SCREW RADIAL CONNECTOR FOR ELECTRIC WIRES

(75) Inventor: Shan-Jui Lu, Xizhi (TW)

(73) Assignee: Lantek Electronics Inc., Xizhi (TW)

( * ) Notice: Subject to any disclaimer, the term of this patent is extended or adjusted under 35 U.S.C. 154(b) by 0 days.

(21) Appl. No.: 11/079,254

(22) Filed: Mar. 15, 2005

(65) Prior Publication Data

US 2006/0035532 A1 Feb. 16, 2006

Related U.S. Application Data

(63) Continuation-in-part of application No. 10/915,395, filed on Aug. 11, 2004.

(30) Foreign Application Priority Data

Jan. 4, 2005 (TW) ..... 94200066 U

(51) Int. Cl.
*H01R 4/66* (2006.01)
*H01R 13/648* (2006.01)

(52) U.S. Cl. ..... 439/97; 439/811

(58) Field of Classification Search ..... 439/810–812, 439/95–97, 469

See application file for complete search history.

(56) References Cited

U.S. PATENT DOCUMENTS 3,864,005 A * 2/1975 Klein ..... 439/812
5,533,913 A * 7/1996 Boehm et al. ..... 439/810
6,339,190 B1 * 1/2002 Chung ..... 174/50

* cited by examiner

*Primary Examiner*—Hae Moon Hyeon
(74) *Attorney, Agent, or Firm*—Troxell Law Office, PLLC

(57) ABSTRACT

A screw radial connector for electric wires includes a case, a connecting base, a press member and a bolt. The case is capable of providing coaxial cable connector. The connecting base, being integrally attached to a lateral side of the case has a top with a lock hole extending downward from the top to communicate with a receiving part. A stop part is disposed at an inner side of a lateral wall of the receiving part extending inward and upward and a lead rod is opposite to the stop part and passes through the bottom and the top of the connecting base. The press member is a hollow box with an open side with a top groove at an upper side thereof and an inner chamber under the upper side communicating with the top groove.

3 Claims, 4 Drawing Sheets

SCREW RADIAL CONNECTOR FOR ELECTRIC WIRES

The Application is continuation-in-part of application Ser. No. 10/915,395 filed Aug. 11, 2004.

FIELD OF THE INVENTION

The present invention relates to an improved screw radial connector for electric wires and particularly to an invention derived from U.S. patent application Ser. No. 10/915,395 for confining the press seat moving along radial direction horizontally with a lead rod and preventing the press seat from escaping.

BACKGROUND OF THE INVENTION

Due to the coaxial cable hub having voltage, in order to prevent signal from being interfered and the operators from getting electric shock, usually the grounding is provided, that is, the grounding wires is associated with the coaxial cable hub.

There are patents related to the way for joining the grounding wires to the coaxial cable hub such as Taiwanese Patent Application No. 88221149. In fact, the device to join the grounding wire has to consider convenience during assembling and firmness during being pressed. Further, it is more important thing has to be considered is that part therein being prevented from loosening and getting lost.

The U.S. patent application Ser. No. 10/915,395, which was filed by the present applicant, discloses a connecting base being attached to the casing with a press member inside being pressed by a bolt while the bolt is fastened to tightly contact the grounding wire for improving conventional connecting way of the grounding wires.

SUMMARY OF THE INVENTION

An improved screw radial connector for electric wires of the present invention includes a case, a connecting base, a press member and a bolt. The a case is capable of providing coaxial cable connector. The connecting base, being integrally attached to a lateral side of the case has a top with lock hole extending downward from the top to communicate with a receiving part formed by the top, a bottom and two lateral walls. A stop part is disposed at an inner side of one of the lateral walls extending inward and upward and a lead rod is opposite to the stop part and passes through the bottom and the top of the connecting base. The press member is a hollow box with an open side with a top groove at an upper side thereof and an inner chamber under the upper side communicating with the top groove. The bolt has a head for being operated with a hand tool, a first screw thread section and a second screw thread section with the outer diameter thereof greater than a width of the top groove respectively and a neck section with the outer diameter thereof less than the hollow part. Once the bolt moves into the receiving part during being fastened to the lock hole and the top groove coincides with the hollow part, the lead rod is located to allow the press member keeping horizontal due to being confined by the lead rod and the stop part and the press member can be blocked by the lead rod to prevent from escaping during moving upward away the stop part.

BRIEF DESCRIPTION OF THE DRAWINGS

The present invention can be more fully understood by reference to the following description and accompanying drawings, in which.

DETAILED DESCRIPTION OF THE INVENTION

Figure 1:
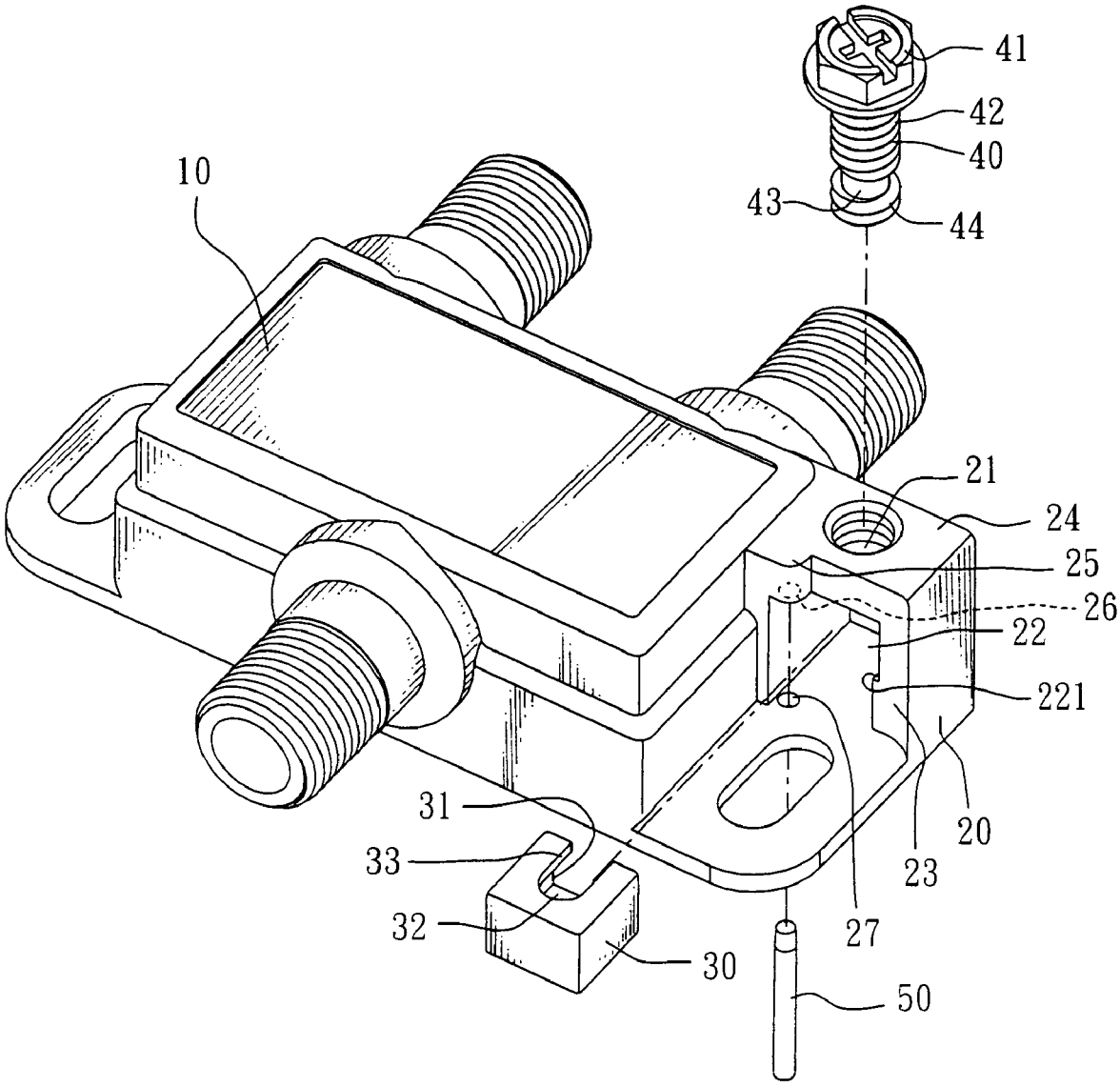
FIG. 1 is a partly disassembled perspective view of a screw radial connector for electric wires according to the present invention.

Referring to FIG. 1, a screw radial connector for electric wires according to the present invention is derived from application Ser. No. 10/915,395 so that identical parts are designated the same reference numbers. Basically, the screw radial connector for electric wires comprises a case 10, a connecting base 20, a press member 30, a bolt 40 and a guide rod 50.

Wherein, the case 10 is used for connecting with a coaxial cable connector and because it is known art, no detail will be described further.

The connecting base 20 is provided at a lateral side of the case 10 and it is preferable that the connecting base 20 is integral with the case 10. The connecting base 20 is for joining and fixing grounding wires so that a lock hole 21 is provided at the top thereof for engaging with a bolt 40. A receiving part 22, which has a through accommodating space, is disposed between the lower part of the connecting base 20 and the bottom of the lock hole 21 and a lateral lower inner side of the connecting base 20 extends inward and upward a stop part 221 to prevent the press member 30 from loosening while the bolt 40 is fastened to the lock hole 21. The preceding description has been disclosed in U.S. patent application Ser. No. 10/913,395. The improvement of the present invention is in that a lead rod 50 is provided at the opposite side of the stop part 221 in the connecting base 20. The lead rod 50 can be integrally with the connecting base 20 and the case 10 or can be pass through a guide hole 27 at the bottom of the connecting base 20 to insert into a locating hole 26, which extends upward from the bottom of a jut part 25 at the top of the connecting base 20 and corresponding to the guide hole 27 so that the lead rod 50 is riveted at the outside of the guide hole 27 as the embodiment shown in FIG. 1. Alternatively, the lead rod 50 can provide screw threads at the upper end thereof to engage with the top 24 by means of a nut after the screw thread end passing through the guide hole 27 and the locating hole 26. This an equivalent implement with rivet joint and no detail will be described further.

The press member 30, which is the same as the trapezoidal piece of the U.S. patent application Ser. No. 10/915,395, can be received in the receiving part 22 and is a hollow box with an open side. The press member 30 has a pair of inner arms 31 to form an inner chamber 32 with a press groove 33 at the top thereof. The press groove 33 has a width is less than the first thread section 42 and the second thread section 44 of the blot 40 and is greater than neck section 43 thereof with a bolt head 41 for being triggered with a hand tool.

Figure 2:
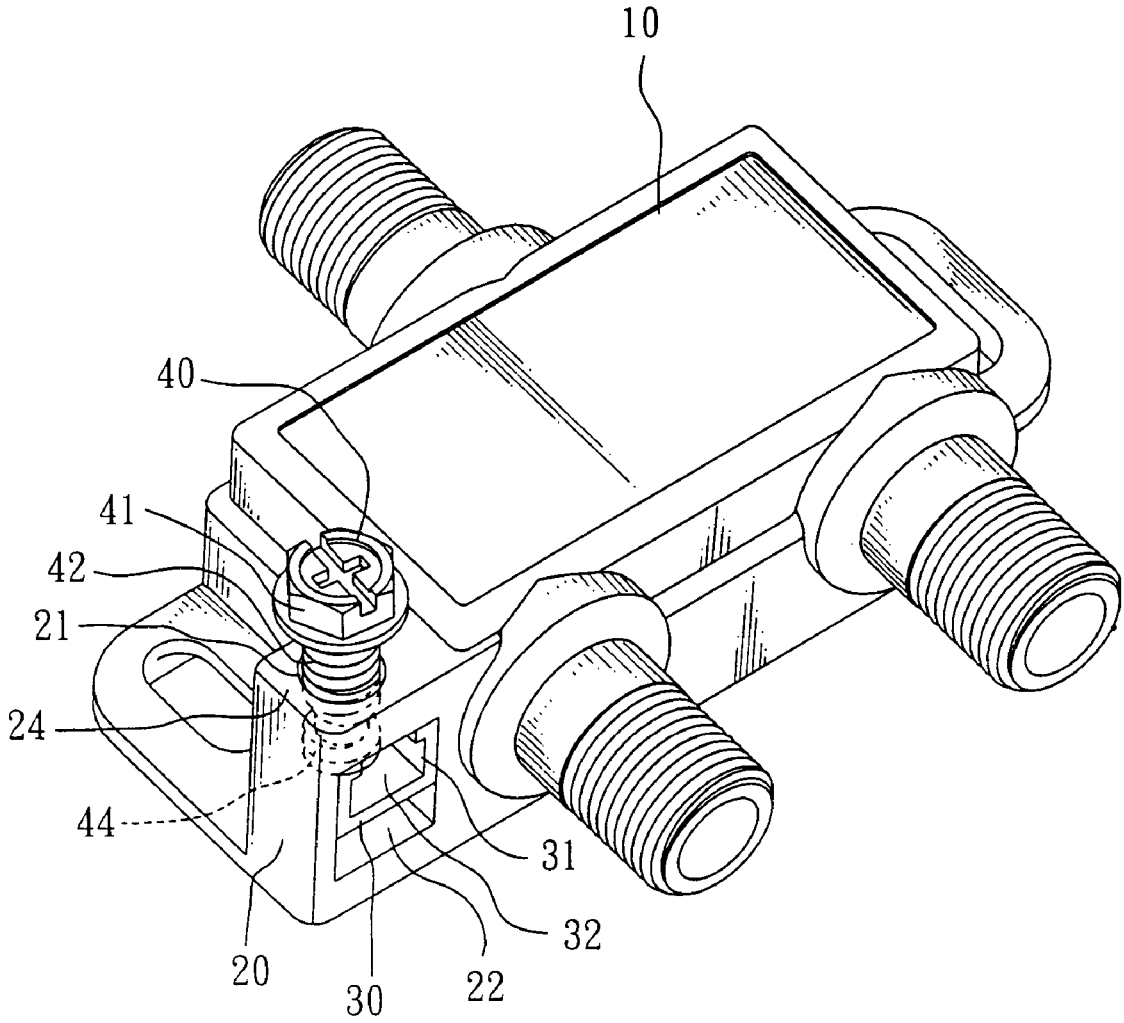
FIGS. 2 is another perspective view of a screw radial connector for electric wires according to the present invention.
Figure 3:
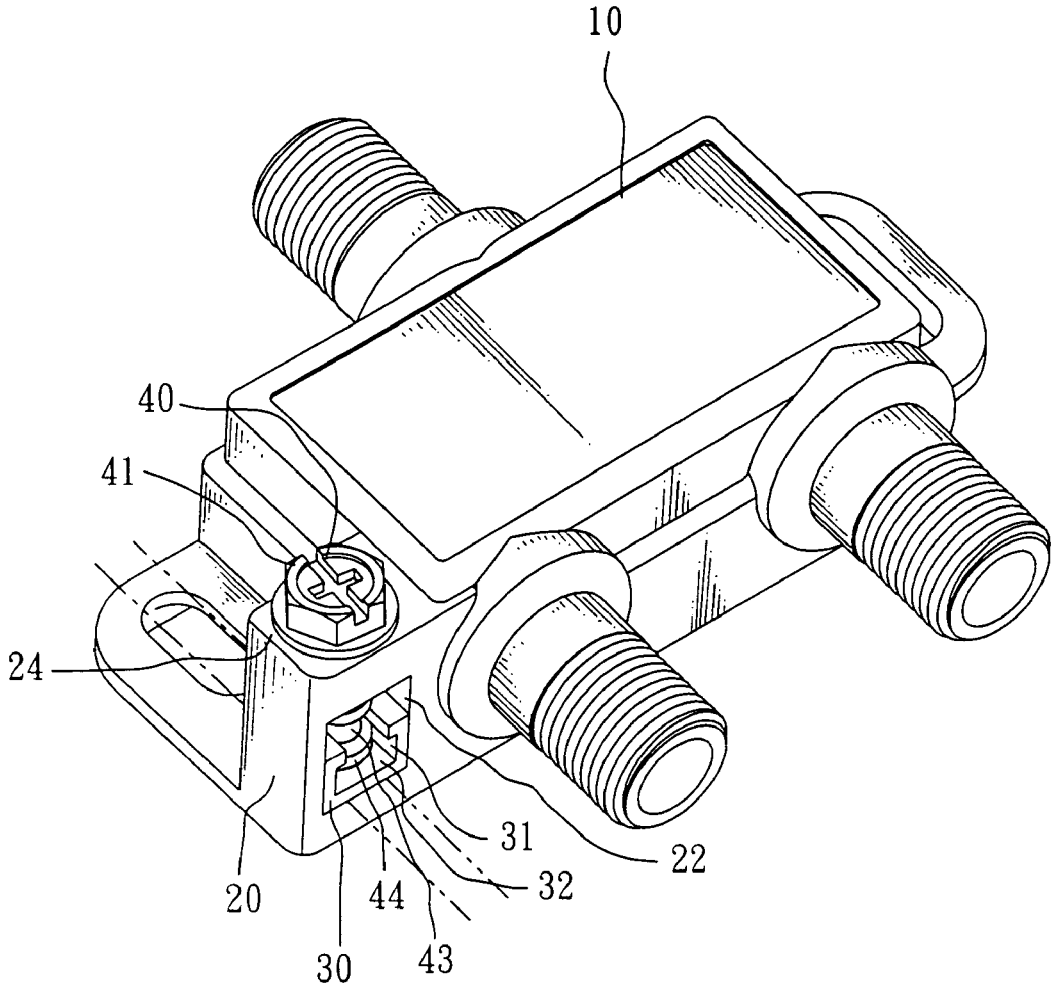
FIG. 3 is a perspective view illustrating the screw radial connector for electric wires of the present invention pressingly engaging with grounding wires.
Figure 4:
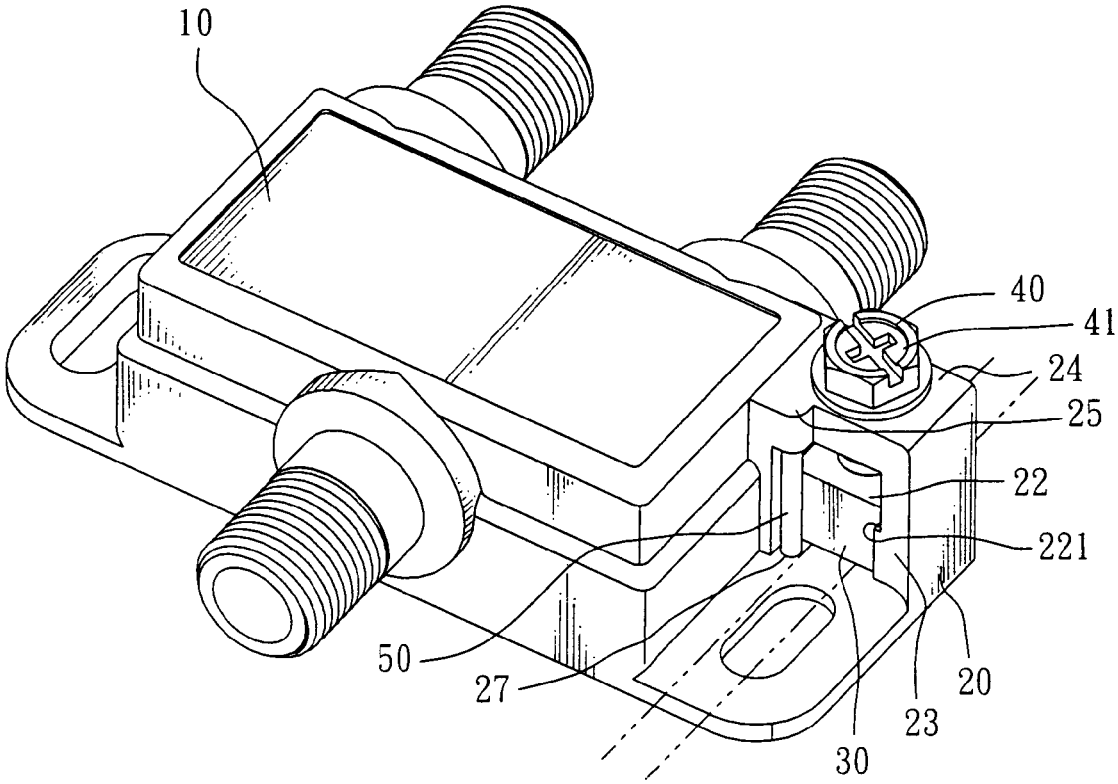
FIG. 4 is another perspective view illustrating the screw radial connector for electric wires of the present invention pressingly engaging with grounding wires.

Referring to FIGS. 2, 3 and 4, when the screw radial connector for electric wires according to the present invention is set up, the bolt 40 is fastened to the receiving part 22 and the press member 30 is placed in receiving part 22 to allow the neck part 43 of the bolt 40 being disposed at the press groove 33 with the lead rod 50 being positioned between the locating hole 26 and guide hole 27.

Referring to FIG. 3 again, the grounding wire (strip shaped wire shown in the figure) passes downward through the bottom of the press member 30 and then the bolt 40 moves downward during being fastened to the lock hole 21 to urge the press member 30 downward horizontally due to being confined by the lead rod 50 and the stop part 221 such that the grounding wire can be pressed firmly.

When the bolt 40 is loosened, the press member 30 is disposed at the upper part of the receiving part 22 to free from stop part 221. Further, the lead rod 50 can prevent the press member 30 from escaping. In this way, the press member 30 keeps being blocked and confined in the receiving part 22 instead of escaping outward.

It is appreciated that the screw radial connector for electric wires according to the present invention can prevent the press member 30 from being apart the stop part 221 in addition to moving horizontally due to being confined by the lead rod 50 so as to perfectly enhance performance of the entire structure thereof.

While the invention has been described with reference to the a preferred embodiment thereof, it is to be understood that modifications or variations may be easily made without departing from the spirit of this invention, which is defined by the appended claims.

What is claimed is:

1. An improved screw radial connector for electric wires, comprising:

a case, being capable of providing coaxial cable connector;

a connecting base, being integrally attached to a lateral side of the case, having a top with a lock hole extending downward from the top to communicate with a receiving part, and providing a stop part being disposed at an inner side of a lateral wall of the receiving part extending inward and upward and having a lead rod being opposite to the stop part and passing through the bottom and the top;

a press member, being a hollow box with an open side, having a top groove at an upper side thereof and having an inner chamber under the upper side communicating with the top groove;

a bolt, having a head for being operated with a hand tool, having a first screw thread section and a second screw thread section with the outer diameter thereof greater than a width of the top groove respectively and a neck section with the outer diameter thereof less than the hollow box;

whereby, once the bolt moves into the receiving part during being fastened to the lock hole and the top groove coincides with the hollow box, the lead rod is located to allow the press member keeping horizontal due to being confined by the lead rod and the stop part and the press member can be blocked by the lead rod to prevent from escaping during moving upward away the stop part.

2. The improved screw radial connector for electric wires as defined in claim 1, wherein the lead rod passes through a guide hole at the bottom of the connecting base to insert into a locating hole, which extends upward from the bottom of a jut part at the top of the connecting base and corresponding to the guide hole so that the lead rod is riveted at the outer end of the guide hole.

3. The improved screw radial connector for electric wires as defined in claim 1, wherein the lead rod passes through a guide hole at the bottom of the connecting base to insert into a through locating hole, which extends upward from the bottom of a jut part at the top of the connecting base and corresponding to the guide hole so that the lead rod is secured at the jut part.

* * * * *